US006288337B1

(12) United States Patent
Sato et al.

(10) Patent No.: US 6,288,337 B1
(45) Date of Patent: Sep. 11, 2001

(54) MULTICONDUCTOR CABLE

(75) Inventors: Kazuhiro Sato; Hideo Kikuchi, both of Kanuma (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 09/516,206

(22) Filed: Feb. 29, 2000

(30) Foreign Application Priority Data

Oct. 26, 1999 (JP) ..... 11-304365

(51) Int. Cl.[7] ..... H01B 17/00
(52) U.S. Cl. ..... 174/71 R; 174/113 R
(58) Field of Search ..... 174/71 R, 72 R, 174/72 A, 113 R, 102 SP; 138/128

(56) References Cited

U.S. PATENT DOCUMENTS 3,510,827 * 5/1970 Spangler ..... 174/71 R X
3,761,603 * 9/1973 Hays et al. ..... 174/72 A X
5,352,855 * 10/1994 Potter ..... 174/71 R X

* cited by examiner

*Primary Examiner*—Chau N. Nguyen
(74) *Attorney, Agent, or Firm*—Smith, Gambrell & Russell, LLP

(57) ABSTRACT

A multiconductor cable in which a plurality of cables, each having at least a conductor and an insulator covering a periphery thereof, are aligned at a predetermined part thereof by an alignment member. The alignment member is a pipe in which the plurality of cables are inserted. The pipe is provided with a slit extending in an axial direction thereof and having a width ranging from about 1 to 2 times the outside diameters of all of cables. A predetermined number of cables among the plurality of cables are drawn out from within the pipe and secured while being aligned in the slit in the axial direction of the pipe.

16 Claims, 9 Drawing Sheets

MULTICONDUCTOR CABLE

BACKGROUND OF THE INVENTION

1. Field of the Invention

The present invention relates to a multiconductor cable in which a plurality of cables, each comprising at least a conductor and an insulator covering the periphery of the conductor, are arranged in a row and shaped into a bent form.

2. Related Background Art

In a medical instrument such as an endoscope or an electronic instrument such as a thin-sized portable computer, for example, a plurality of signal lines in a predetermined form are arranged in a narrow space such as the inside of a tubular component. Terminals of these plurality of signal lines are connected to sensors, connectors, and the like, for example, while in alignment therewith. If the sensors, connectors, and the like are located in a direction intersecting the direction in which the signal lines extend (the longitudinal direction of the wiring), it is necessary for the signal lines to be bent with a variable angle toward the sensors, connectors, and the like, while being aligned near their terminals, so as to yield a bent form.

Specific examples of signal lines to be thus aligned and shaped into a bent form include those having at least a conductor and an insulator covering the periphery of the insulator (hereinafter collectively referred to as a cable) such as a simple coated line comprising a conductor and a casing, as an insulator, covering the periphery of the conductor; a coaxial cable comprising a center conductor, an insulator covering the periphery of the center conductor, and an outer conductor covering the periphery of the insulator; one further comprising a sheath around the outer conductor; and the like.

Known as a conventional multiconductor cable in which a plurality of cables in such a mode are aligned and shaped into a bent form is one using a grooved jig. The grooved jig comprises a thin sheet formed with a plurality of bent grooves disposed in parallel. The cables are successively fitted into these grooves in the order of their alignment while being bent, so as to yield bent forms arranged in a row. The cables thus fitted are secured to the grooved jig with an adhesive tape or the like, for example. It is easy to attach them to sensors, connectors, and the like upon termination. The grooved jig used here is removed after the attaching operation.

SUMMARY OF THE INVENTION

When such a grooved jig is employed, a plurality of cables are fitted into their respective grooves one by one while being bent, so as to align with each other. Therefore, in order to prevent the bent cables from becoming detached from their grooves as they tend to restore their original shape due to their elasticity, the aligning operation has to be carried out while pressing the cables at a plurality of positions along the grooves, whereby the workability will be degraded.

For improving the workability, there has been known a method comprising the steps of linearly extending a plurality of cables having the same length while aligning them in parallel without using the above-mentioned grooved jig or the like; terminating them so as to connect sensors, connectors, and the like to their terminals; and then collectively bending the cables near their terminals in a direction for attaching the sensors, connectors, and the like. This method, however, is problematic in that cables on the inner peripheral side of the bending direction may slacken, so that the alignment of the individual cables in a part distanced from the attaching portion may be disordered, whereby it becomes difficult to effect high-density wiring into a narrow space. If these plurality of signal lines are turned around in the direction opposite from the bending direction so as to absorb the slackness, on the other hand, then various restrictions in terms of design may occur in that arrangement and directions of sensors, connectors, and the like are limited while it is difficult to secure the wiring space.

In order to overcome such a problem, it is an object of the present invention to provide a multiconductor cable in which, while a plurality of cables are aligned, a predetermined number of cables are drawn out with a bent form in a state arranged in a row, wherein the workability at the time of yielding the bent form is improved.

The multiconductor cable in accordance with the present invention is a multiconductor cable in which a plurality of cables, each having at least a conductor and an insulator covering a periphery thereof, are aligned at a predetermined part thereof by an alignment member, wherein the alignment member comprising a pipe in which the plurality of cables are inserted, with a slit extending in an axial direction thereof and having a width ranging from about 1 to 2 times the outside diameters of all of said cables, and a predetermined number of cables among the plurality of cables being drawn out from within the pipe and secured while being aligned in the slit in the axial direction of the pipe.

In thus configured multiconductor cable, a simple operation of feeding a plurality of cables into the slit of the pipe in conformity with a predetermined order of arrangement causes these plurality of cables to change their angles from their linear state, so as to be arranged in a row in the slit without changing their order, drawn out from within the pipe, and secured to the pipe. Therefore, while the linear state of the plurality of cables before reaching the slit is mostly maintained, it becomes easier to align these cables and yield a bent form thereof.

Here, specific examples of the cables include a coated cable comprising a conductor and a sheath, as an insulator, covering the periphery of the conductor; a coaxial cable comprising a center conductor, an insulator covering the periphery of the center conductor, and an outer conductor covering the periphery of the insulator; one further comprising a sheath around the outer conductor; and the like.

Preferably, the slit extends from one end portion of the pipe to an intermediate portion of the pipe. When such a configuration is employed, a simple operation of successively feeding cables into the slit and shifting them toward the closed end of the slit arranges the cables in a row, whereby it becomes much easier to arrange the cables and yield a bent form thereof. Also, in the case where one side of the slit is closed, even when an external force acts on the pipe, the slit width is prevented from narrowing, so that a predetermined width is secured, whereby the cables are prevented from being damaged by the slit portion.

In the case where both end portions of the pipe are provided with slits, as compared with the case where a long slit is provided so as to extend from only one end portion of the pipe, the retention force for securing the slit width becomes greater, thus preventing the cables from being damaged by the slit portion.

Also, when a plurality of slits are disposed in a circumferential direction of the pipe, bent forms can be provided in a plurality of directions while the plurality of cables are aligned.

If the external surface of the pipe has a flat surface, then the pipe will not rotate when mounted on an instrument with this flat surface, whereby the mounting will become easier and more reliable.

If this pipe is disposed at the midsection of at least one cable among a plurality of cables, then it will also be applicable to cases where a part of cables are branched out partway.

The pipe is preferably formed such that the periphery thereof is constituted by a combination of two or more constituent members at any position in the axial direction of the pipe. In such a configuration, when attaching the pipe to midsection of a plurality of cables, the constituent members can be combined together so as to form and attach the pipe without necessitating an operation of passing the pipe from an end portion of the cables, whereby the workability would improve. Further, when moving the pipe to its aimed position, the pipe and the cables can be kept from coming into contact with each other, whereby the cables can be prevented from being damaged.

Also, a predetermined number of drawn-out cables may be provided with a collective connector for securing and electrically connecting a terminal portion thereof. Its attachment is quite easy, and the handling becomes simpler.

If each cable has an outer conductor, then it is possible to employ a configuration in which the respective outer conductors of the drawn-out cables are joined to each other and secured to the pipe by way of an electrically conductive bonding layer such as solder, electrically conductive adhesive, or the like, for example. Here, the pipe may be constituted by a solderable electrically conductive material and bonded with solder.

Further, when at least a part of the plurality of cables is contained within a grounded conductor tube, while the conductor tube and the pipe are electrically joined to each other, then the outer conductors would be grounded by way of the pipe and the conductor tube even if the outer conductors are not grounded in particular, while the conductor tube joined to the pipe enhances the retention strength of the pipe.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

FIG. 1 is a perspective view showing a first embodiment of the multiconductor cable in accordance with the present invention, whereas

FIG. 3 is a perspective view showing amode of assembly of the multiconductor cable before reaching an alignment member, whereas

DESCRIPTION OF THE PREFERRED EMBODIMENTS

Figure 1:
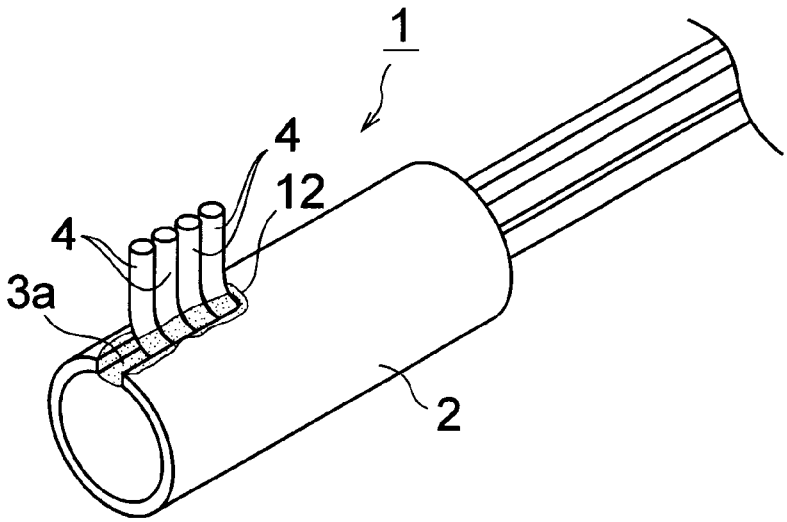

In the following, preferred embodiments of the present invention will be explained with reference to the accompanying drawings. FIG. 1 is a perspective view showing a first embodiment of the multiconductor cable in accordance with the present invention. A multiconductor cable takeout portion 1 in this embodiment is employed in a narrow space such as the inside of a tubular component or the like of a medical instrument such as an endoscope or an electronic instrument such as a thin-sized portable computer, in order for a plurality of cables 4 arranged in parallel close to each other orienting in one direction to change their angles from this linear state so as to form a terminal while being arranged in a row. Here, a coaxial cable is used as each cable 4.

Figure 2:
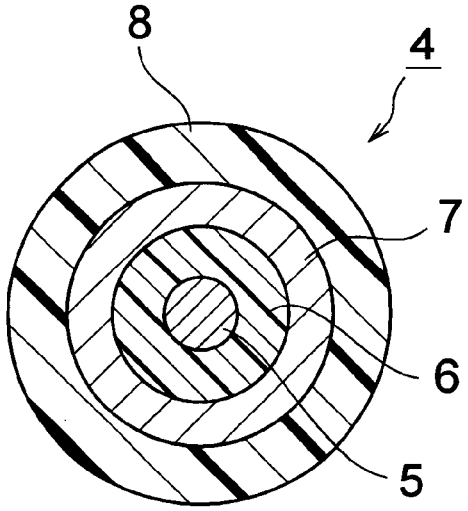
FIG. 2 is a transverse sectional view of each cable in this multiconductor cable.
Figure 3:
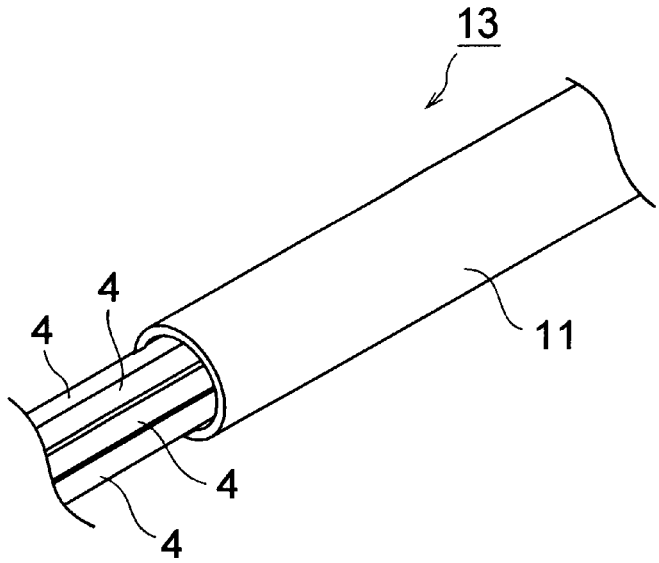

As shown in FIG. 2, the coaxial cable 4 comprises a center conductor 5, an insulator 6 covering the periphery of the center conductor 5, and an outer conductor 7 covering the periphery of the insulator 6, which are arranged on the same axis, whereas the periphery of the outer conductor 7 is covered with a sheath (insulator) 8. As shown in FIG. 3, a plurality of coaxial cables 4 are assembled as a multiconductor cable 13 before reaching a pipe 2 constituting the takeout portion 1.

Figure 4:
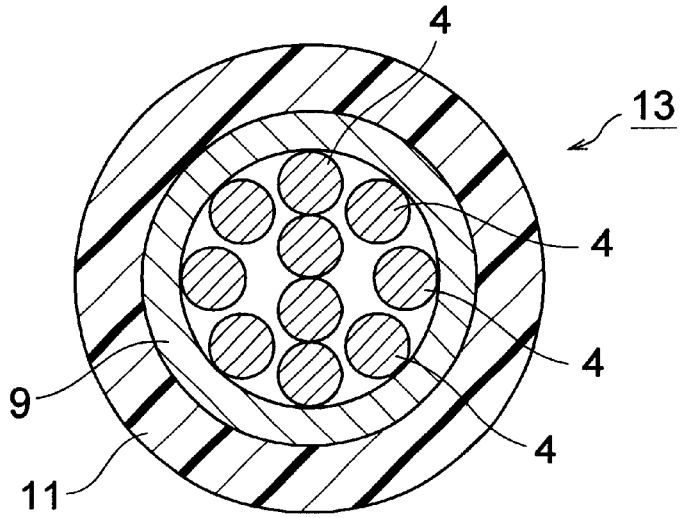
FIG. 4 is a transverse sectional view of the part of the multiconductor cable shown in FIG. 3.

In the multiconductor cable 13, as shown in FIG. 4, a plurality of coaxial cables 4 are covered with an outer sheath (insulator) 11 by way of a spirally wound conductor 9 as a grounding shield layer. As shown in FIG. 3, the plurality of coaxial cables 4 contained inside thereof are arranged in parallel close to each other so as to orient in one direction. On the terminal side, these coaxial cables 4 are drawn out of the outer sheath 11 and introduced (inserted) into the pipe 2 as shown in FIG. 1.

The pipe 2 is provided with a slit 3*a* extending in the axial direction of the pipe 2 from an end portion of the pipe 2 so as to be cut partway through the pipe 2 in the axial direction thereof. In order to allow the coaxial cables 4 to enter while preventing them from exchanging their positions in the slit 3*a*, the width of the slit 3*a* is set ranging from about 1 to 2 times the outside diameter of the coaxial cables 4. Also, the length of the slit 3*a* is appropriately determined according to the number of coaxial cables 4 to be taken out through the slit 3*a*.

For easier connection to sensors, connectors, and the like, for example, as termination, the terminals of the plurality of coaxial cables 4 are fed to the slit 3*a* in the order of their alignment at the time of their terminal formation while changing angles from their linear state, so as to be arranged in a row and drawn out from within the pipe 2. The plurality of coaxial cables 4 drawn out from the slit 3*a* in a row are secured to each other and to the pipe 2 with an adhesive 12, for example.

Figure 9:
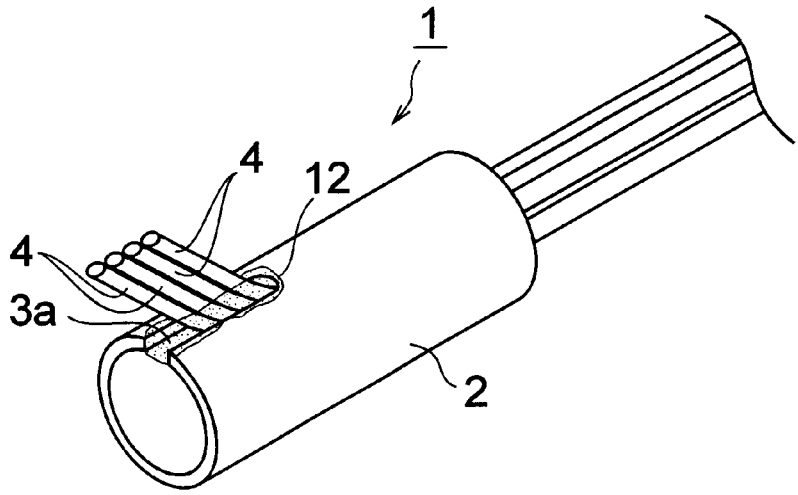
FIG. 9 is a perspective view showing another mode of draw-out direction of cables aligning in a slit.

The draw-out direction of these coaxial cables 4 is appropriately selected according to the terminating direction in which sensors, connectors, and the like are disposed, for example, from a direction forming substantially a right angle with the axis of the pipe 2 as shown in FIG. 1, a direction forming an acute angle with the slit side of the axis of the pipe 2 as shown in FIG. 9, and a direction forming an obtuse angle therewith.

Preferably, in order to clarify the order of feeding the coaxial cables 4 into the slit 3*a* at the time of feeding and aligning them in the slit 3*a* so as to facilitate the operation, their respective exposed parts such as the sheaths 8, as the outermost layer, have colors different from each other.

Also, the pipe 2 is molded from a resin, for example. As a consequence, it can be formed by injection molding, and its formation flexibility is so high that, for example, a formation which tends to be integrated with sensors, connectors, and the like connected to the terminals can easily be selected.

As for the material for constituting the pipe 2, thermoplastic materials such as polypropylene, polyethylene terephthalate, and polycarbonate, for example, and the like can be selected as appropriate. For making it hard for the coaxial cables 4 to break upon being rubbed against the pipe 2 in contact therewith, for example, it is preferable to use a material having a hardness lower than that of the sheath 8 as the outermost layer of the coaxial cable 4. As the adhesive 12, an epoxy type adhesive or the like is appropriately selected, for example.

The inside and outside diameters of the pipe 2 are appropriately selected according to the outside diameter and number of the coaxial cables 4 contained in the pipe 2, whether the pipe 2 is secured or not, and the like. For example, in the case of a 10 conductor cables (see FIG. 4) in which the outside diameter of the outer sheath 11 is 1.5 mm, pipes whose inside diameter is as large as or smaller than the outside diameter of the outer sheath 11, such as those having an inside diameter of 1.0 mm and an outside diameter of 1.2 mm, are employable. Namely, in this embodiment, for improving the wiring space efficiency, employed as the pipe 2 is a pipe whose outside diameter is not substantially different from that of the multiconductor cable 13 as the assembly before reaching the pipe 2.

In thus configured cable takeout portion 1, upon a simple operation of causing a plurality of coaxial cables 4 as cables arranged in parallel close to each other orienting in one direction to be fed into the slit 3*a* of the pipe 2 in the order of their alignment at the time of terminal formation, these plurality of coaxial cables 4 change angles from this linear state, so as to be arranged in a row in the slit 3*a* without changing their order, drawn out from within the pipe 2, and secured to the pipe 2. As a consequence, while the linear state of the plurality of coaxial cables 4 before reaching the pipe 2 is mostly maintained, it becomes easier to align these coaxial cables 4 and yield a bent form thereof. Hence, while enabling high-density wiring, the workability is improved.

In addition, employing such a configuration, i.e., one in which the slit 3*a* arranges the plurality of coaxial cables 4 in a row and yields a bent form, eliminates the problem in the conventional case of using a grooved jig, i.e., the problem that the size of the aligned portion of the cables (coaxial cables in this embodiment) becomes greater in their aligning direction due to partitions between grooves so as to lower the spatial efficiency within the instrument, and further makes it hard to generate the problem that, since the spatial efficiency is low, the cables and other instrument components interfere with each other and damage each other.

Also, since a simple operation of successively feeding the coaxial cables 4 into the slit 3*a* and shifting them toward the closed end of the slit 3*a* arranges the coaxial cables 4 in a row, it is much easier to align the coaxial cables 4 and yield their bent form. As a consequence, the workability is further improved. Also, since one side of the slit 3*a* is closed as such, even when an external force acts on the pipe 2, the slit width is kept from narrowing, so that a predetermined width is secured, whereby the coaxial cables 4 are prevented from being damaged. Hence, the reliability of the coaxial cables 4 is improved.

Here, the width of the slit 3*a* is set ranging from about 1 to 2 times the outside diameter of the coaxial cable 4. In particular, it is preferred that the width be greater than the outside diameter of each of the aligned coaxial cables 4 by 0.01 mm or more in view of the easiness in operation, and that the width be not greater than about 1.5 times the outside diameter of the coaxial cable 4 taking account of the case where the coaxial cables 4 move within the slit 3*a* while the coaxial cables 4 deform under the action of forces thereon. Also, in order to keep the alignment of the coaxial cables 4 from being disordered in the slit 3*a* when the coaxial cables 4 are secured to the pipe 2, it is preferred that the outside diameter of the coaxial cable 4 and the width of the slit 3*a* are close to each other. In particular, if the width of the slit 3*a* is about 1.1 times the outside diameter of the coaxial cable 4, then the displacement of the coaxial cable 4 in the width direction thereof will be about 10% of the outside diameter of the coaxial cable 4, thereby facilitating the terminating operation for connecting terminals to sensors, connectors, and the like.

A metal pipe may be employed in place of the resin pipe 2. As the metal material for constituting this pipe 2, materials such as copper, aluminum, stainless steel, and the like, for example, are selected as appropriate. In particular, for medical use and the like, it is preferable to use stainless steel, which is hard to yield rust and is suitable as the material for medical instruments. For securing the metal pipe 2 and the coaxial cables 4, as cables, to each other, the above-mentioned adhesive 12 can be used, for example.

Figure 5:
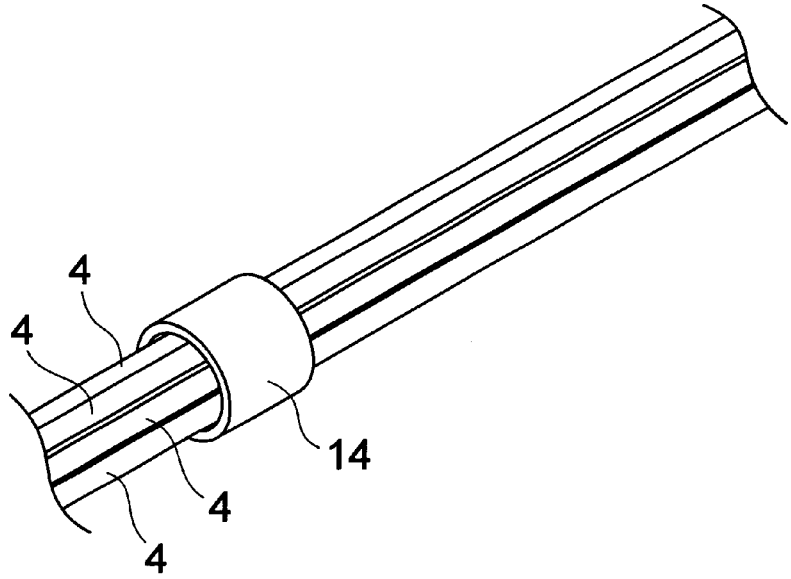
FIG. 5 is a perspective view showing another mode of assembly of the multiconductor cable before reaching an alignment member.

As another mode of assembly before reaching the pipe 2, it is possible to employ one in which, as shown in FIG. 5, coaxial cables 4 are arranged in parallel close to each other so as to orient in one direction as being bundled by an annular band 14.

Figure 6:
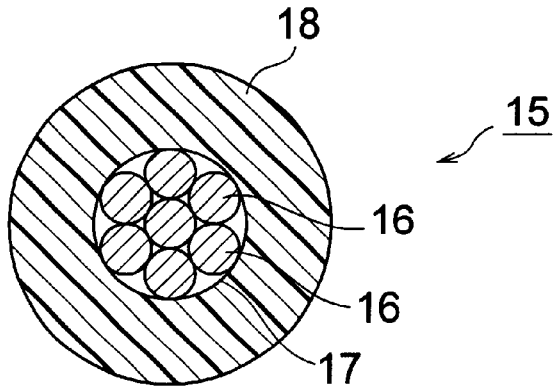
FIG. 6 is a transverse sectional view showing another cable constituting the multiconductor cable.

In place of the coaxial cable 4, a coated cable 15 shown in FIG. 6 may be used. The coated cable 15 comprises a conductor 17 composed of a strand of a plurality of single wires 16 each made of a copper wire, for example, and a sheath 18 as an insulator covering the periphery of the conductor 17.

Figure 7:
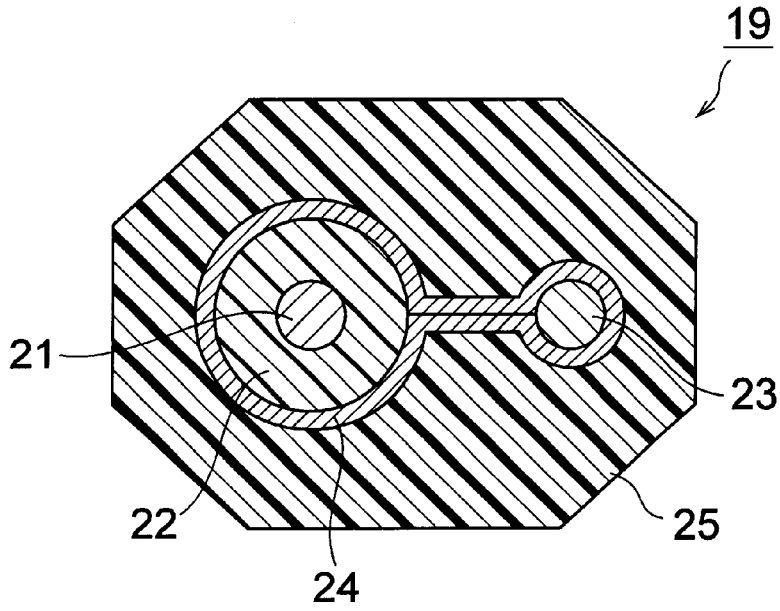
FIG. 7 is a transverse sectional view showing a coaxial cable including a drain wire as still another cable constituting the multiconductor cable.

Also, in place of the coaxial cable 4, a coaxial cable 19 including a drain wire 23 shown in FIG. 7 may be used. In the coaxial cable 19 including the drain wire 23, an insulator 22 is disposed so as to cover the periphery of an inner conductor 21, the drain wire 23 is disposed outside the insulator 22, the periphery of the drain wire 23 and insulator 22 is integrally covered with a metal deposition film 24 as an outer conductor, and the metal deposition film 24 is covered with an outer sheath (insulator) 25 forming a polygon such as an octagon, for example.

In the following embodiments up to the seventh embodiment, for convenience of explanation, the coaxial cable 4, the coated cable 15, the coaxial cable 19 including the drain wire 23, and the like are collectively referred to as cable with numeral 55, if necessary, when they are considered generically, whereas they are referred to by their respective names with their corresponding numerals when their kinds are to be specified.

Figure 8:
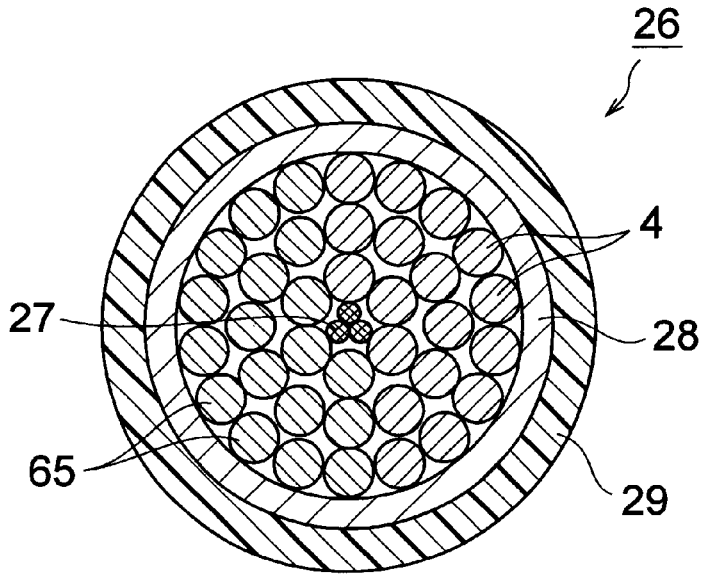
FIG. 8 is a transverse sectional view showing an ultra-multiconductor cable, indicating still another mode of assembly of the multiconductor cable before reaching an alignment member.

As still another mode of assembly before reaching the pipe 2, an ultra-multiconductor cable 26 shown in FIG. 8 may be employed. In the ultra-multiconductor cable 26, for example, a plurality of the above-mentioned coaxial cables 4, a plurality of coaxial cables 65 having a size identical to that of the coaxial cables 4 but being used for a purpose different from that of the coaxial cables 4, and a plurality of coaxial cables 27 having a size different from that of the coaxial cables 4, 65 are covered with an outer sheath 29 by way of a spirally wound conductor 28.

When such a mode of assembly is employed, the coaxial cables 4, 27, 65, on their terminal side, are drawn out from the spirally wound conductor 28 and the outer sheath 29, such that all these coaxial cables, respective parts of the individual cable groups, or at least two selected coaxial cables are introduced into the pipe 2, arranged in a row in the slit 3*a*, and drawn out from within the pipe 2.

The configuration of multiconductor cables such as ultra-multiconductor cables is not limited to that mentioned above. For example, a configuration containing a plurality of kinds of cables whose modes are different from each other, such as coaxial cables and coated cables, may be employed. In this case, all these cables (e.g., all of the coaxial cables and coated cables that are contained), respective parts of the individual kinds, or at least two selected cables are introduced into the pipe 2, arranged in a row in the slit 3*a*, and drawn out from within the pipe 2.

As still another mode of assembly before reaching the pipe 2, it is also possible to employ a complex mode of assembly having ultra-multiconductor cables such as those shown in FIG. 8 and an assembly bundled with the annular band 14 such as that shown in FIG. 5, for example. In this case, all the cables, respective parts of cables in the individual modes of assembly, or at least two selected cables are introduced into the pipe, arranged in a row in the slit 3*a*, and drawn out from within the pipe 2. The complex mode of assembly is not limited to this one, but the same kind of assemblies or three or more kinds of assemblies may be combined as well.

The foregoing is the configuration of the first embodiment having various modes.

Figure 10:
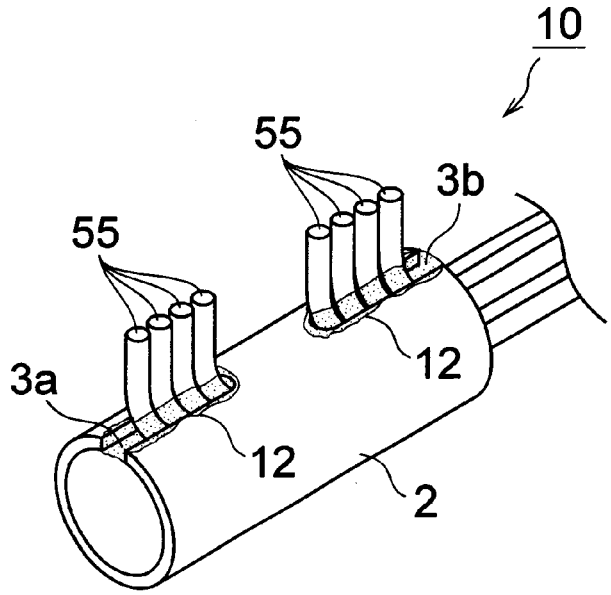
FIGS. 10 to 17 are views showing other embodiments of the multiconductor cable in accordance with the present invention, respectively.

FIG. 10 is a perspective view showing a second embodiment of the multiconductor cable in accordance with the present invention. The cable takeout portion 10 in the second embodiment differs from that of the first embodiment in that a slit 3*b* different from the slit 3*a* is also formed at a pipe end portion on the side opposite from the slit 3*a*, whereas a predetermined number of cables 55 are also arranged in a row in this slit 3*b*, drawn out therefrom while being shaped into a bent form, and secured to the pipe with the adhesive 12 or the like, for example.

Such a configuration can yield effects similar to those of the first embodiment as a matter of course. In addition, as compared with the case where a long slit is provided so as to extend from only one end portion of the pipe 2 (the case where a slit having a length identical to the total length of the slits 3*a*, 3*b* extends from one end portion), the retention force for securing the slit width is greater, so that the cables 55 are prevented from being damaged, and the reliability of the cables 55 is improved. Such a configuration is particularly effective in the case where the number of cables 55 aligning in the slit is large.

Figure 11:
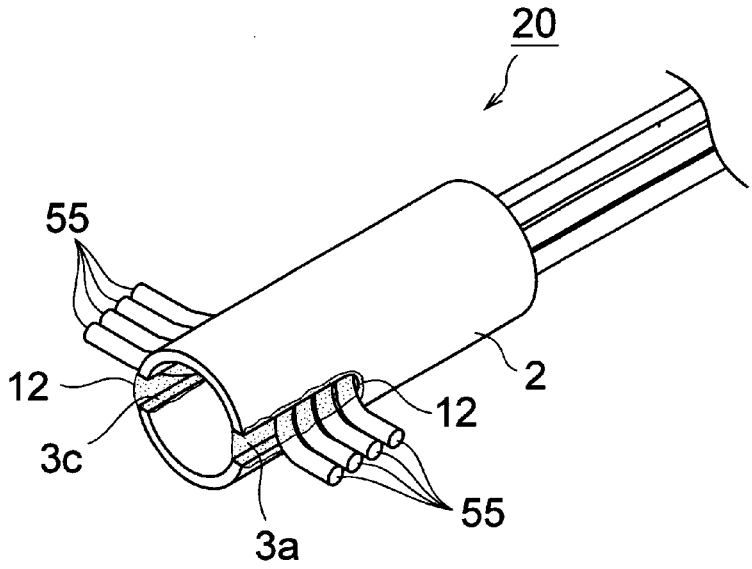

FIG. 11 is a perspective view showing a third embodiment of the multiconductor cable in accordance with the present invention. The cable takeout portion 20 in the third embodiment differs from that of the first embodiment in that a slit 3*c* different from the slit 3*a* is formed at a predetermined position in the circumferential direction of the pipe 2, whereas a predetermined number of cables 55 are also arranged in a row in this slit 3*c*, drawn out therefrom while being shaped into a bent form, and secured to the pipe 2 with the adhesive 12 or the like, for example.

The positions where these slits 3*a*, 3*c* are formed are appropriately selected according to terminating directions in which sensors, connectors, and the like are disposed, for example. Various positions such as those separated from each other by 180° about the axis of the pipe 2 (positions opposite to each other by 180°) as shown in FIG. 11, those separated from each other by 90°, and the like may be selected as appropriate.

Such a configuration can yield effects similar to those of the first embodiment as a matter of course. In addition, since a plurality of cables 55 are aligned and shaped into bent forms in a plurality of directions in the same pipe 2, the range of application can be widened at a lower cost, while a greater number of cables 55 can be terminated.

Though two slits 3*a*, 3*c* extending in the axial direction of the pipe 2 are arranged in the circumferential direction of the pipe 2, more slits may be provided if necessary. Also, the configuration of the third embodiment can be combined with that of the second embodiment as a matter of course.

Figure 12:
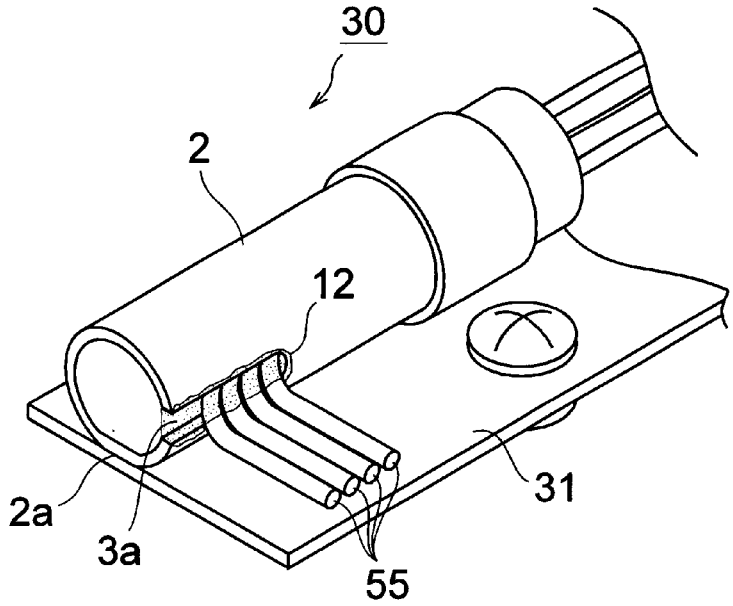

FIG. 12 is a perspective view showing a fourth embodiment of the multiconductor cable in accordance with the present invention. The cable takeout portion 30 in the fourth embodiment differs from that of the first embodiment in that the pipe 2 is provided with a flat surface 2*a* extending in the axial direction of the pipe 2 on the external surface, whereas the flat surface 2*a* is secured to a flat surface 31 such as a wall face within an instrument, a substrate, or the like, for example.

Such a configuration can yield effects similar to those of the first embodiment as a matter of course. In addition, the flat surface 2*a* of the pipe 2 makes it easier to mount the pipe 2 without rotating it, thus improving the mountability, thereby cutting down the cost of manufacture. The configuration of the fourth embodiment can be combined with those of the second and third embodiments as a matter of course.

Figure 13:
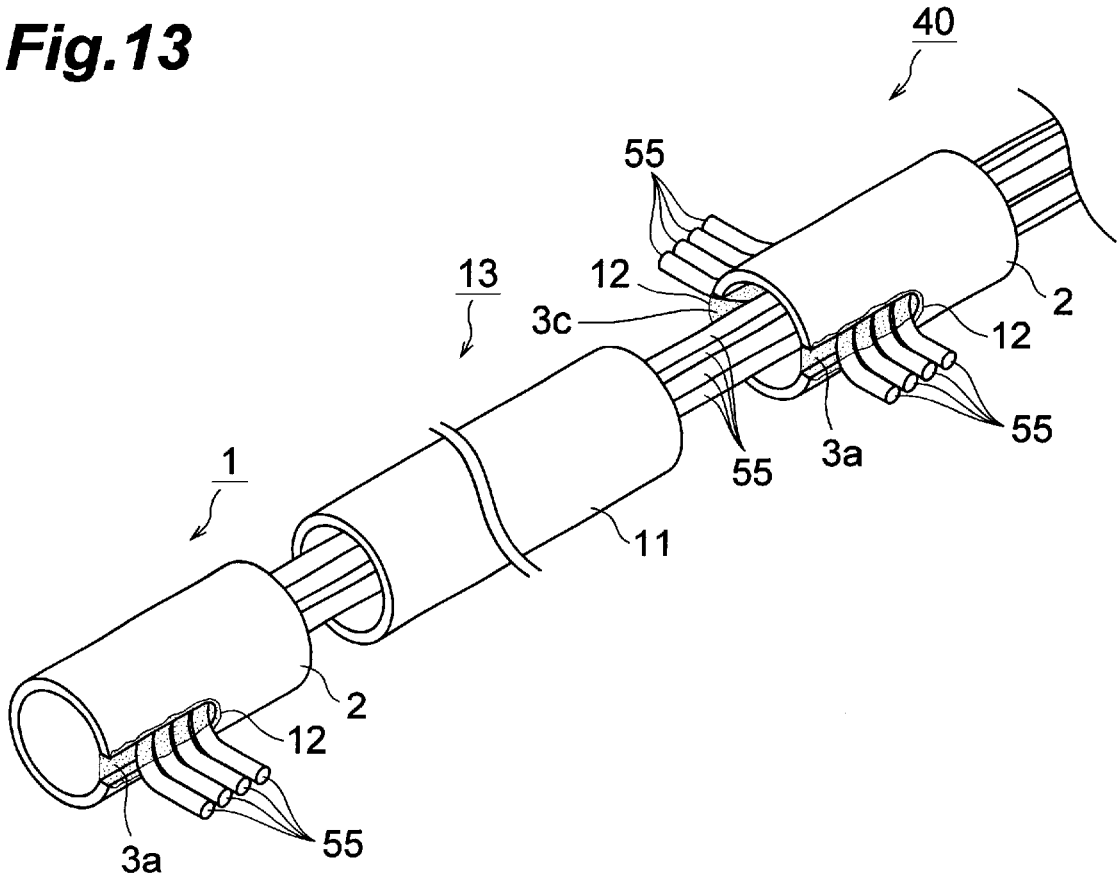

FIG. 13 is a perspective view showing a fifth embodiment of the multiconductor cable in accordance with the present invention. The cable takeout portion 40 in the fifth embodiment differs from that of the first embodiment in that the takeout portion is arranged as a branch for the midsection of the plurality of cables 55 arranged in parallel. While the takeout portion 40 arranged for the midsection of the cables 55 has a configuration similar to that of the takeout portion 20 of the third embodiment, for example, a plurality of cables 55 other than those shaped into a bent form in the takeout portion 40 so as to be drawn out of the pipe 2 are passed through the pipe 2 of the takeout portion 40 so as to be drawn out from an open end thereof.

On the terminal side of the plurality of cables 55 drawn out through the pipe 2 of the takeout portion 40, the takeout portion 1 of the first embodiment, for example, is employed. For a plurality of cables 55 between the takeout portion 1 and the takeout portion 40, the configuration of the multiconductor cable 13 of the first embodiment explained with reference to FIGS. 3 and 4, for example, is employed so as to protect these cables 55 and arrange them in parallel close to each other so that they orient in one direction.

Here, the takeout portion 40 for the midsection of the plurality of cables 55 may be any of the first, second, and fourth embodiments as well, whereas the takeout portion employed on the terminal side may be any of the second to fourth embodiments as well. Also, in place of the configuration of the multiconductor cable 13 disposed between the takeout portion 1 and the takeout portion 40, the annular band 14 of the first embodiment explained with reference to FIG. 5 may be used as well.

Such a configuration can yield effects similar to those of the first embodiment as a matter of course. In addition, it is also applicable to amode in which the takeout portion 40 arranged for the midsection of the plurality of cables 55 branches out a part of the plurality of cables 55 partway, whereby its range of application is widened. Not only a plurality of cables but also a single cable may be passed through the pipe 2 of the takeout portion 40 so as to be drawn out from an open end thereof.

Figure 14:
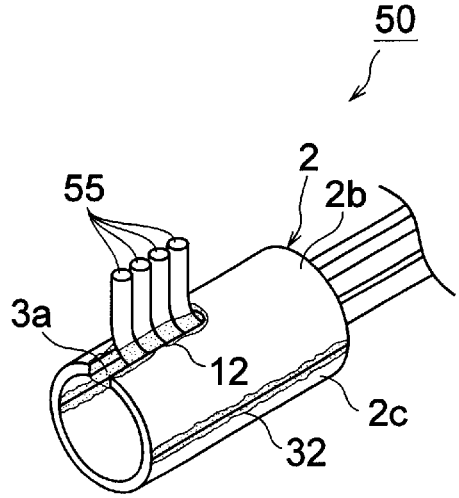

FIG. 14 is a perspective view showing a sixth embodiment of the multiconductor cable in accordance with the present invention. The takeout portion 50 in the sixth embodiment differs from that of the first embodiment in that the pipe 2 is divided along the axis thereof into pipe parts 2*b*, 2*c*, which are used as being combined together at a predetermined position of a plurality of cables 55 so as to hold the cables 55 therebetween. These divided pipe parts 2*b*, 2*c* are secured to each other with an adhesive 32 or the like, so as to be integrated together.

Such a configuration can yield effects similar to those of the first embodiment as a matter of course. In addition, if the pipe 2 is arranged so as to constitute a branch for a midsection of a plurality of cables 55 as in the fifth embodiment in particular, then an operation of introducing the terminals of the plurality of cables 55 into the pipe 2 and moving the pipe 2 toward the midsection of the plurality of cables 55 is unnecessary, whereby the workability improves. Also, since there is no moving of the pipe 2 toward the midsection of the plurality of cables 55, the chance of the cables 55 and the pipe 2 coming into contact with each other is reduced, so that the cables 55 are prevented from being damaged, whereby the reliability of the cables 55 is improved. Here, in the case where the pipe 2 is constituted by a metal, the divided pipe parts 2*b*, 2*c* may be joined to each other by soldering, for example. The configuration of the sixth embodiment can be combined with those of the second to fifth embodiments as a matter of course. The pipe 2 may be divided into not only two parts but also three or more parts. Its mode of division is not limited to the one depicted as long as the divided parts can be combined together so as to hold the cables 55 therein.

Figure 15:
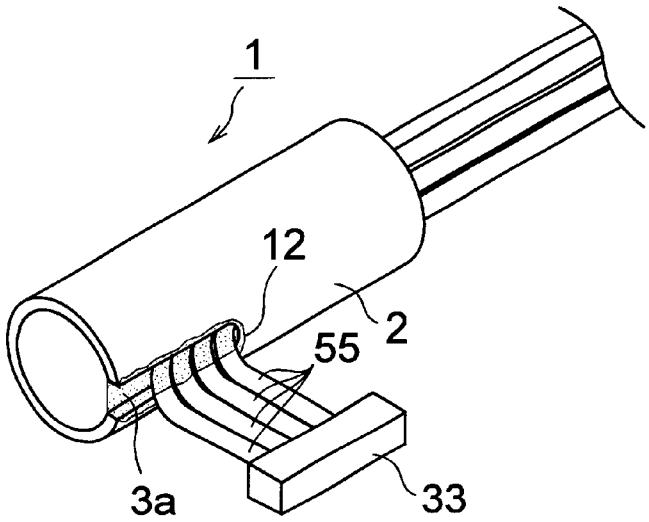

FIG. 15 is a perspective view showing a seventh embodiment of the multiconductor cable in accordance with the present invention. The takeout portion in the seventh embodiment has a configuration similar to the takeout portion 1 in the first embodiment but differs therefrom in that the terminals of a plurality of cables 55 which are bent at the takeout portion 1, arranged in a row, and taken out therefrom are provided with a collective connector 33 for connecting the terminals of these cables 55 in a row.

Such a configuration can yield effects similar to those of the first embodiment as a matter of course. In addition, attachment of the connector 33 is quite easy, and the function as the cable takeout portion 1 is fully exhibited. Here, the configuration of the seventh embodiment can be combined with those of the second to sixth embodiments as a matter of course.

Figure 16:
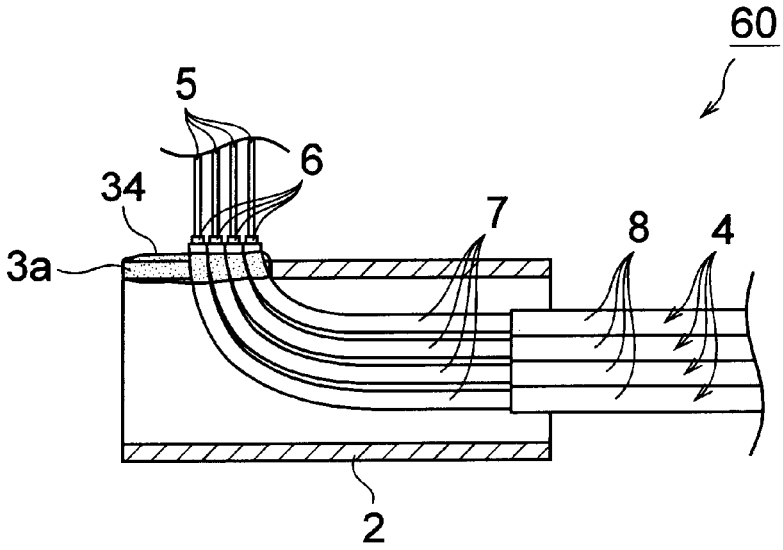

FIG. 16 is a vertical sectional view showing an eighth embodiment of the multiconductor cable in accordance with the present invention. The cable takeout portion 60 in the eighth embodiment differs from that of the first embodiment in that the cables employed in the takeout portion are coaxial cables 4 stripped of their sheath 8 so as to expose outer conductors 7.

As in the first embodiment, these outer conductors 7 are arranged in a row in the slit 3*a* of the pipe 2, shaped into a bent form, and drawn out from within the pipe 2. Here, if the pipe 2 is made of a solderable electrically conductive material such as a metal, for example, it is possible to employ a configuration in which a plurality of outer conductors 7 drawn out from within the pipe 2 are joined to the pipe 2 by way of solder 34, as shown in FIG. 16, so as to be conducted to each other via the pipe 2. As the metal material for constituting the pipe 2, copper or aluminum, which can easily be soldered, is preferably used. When stainless steel is employed as the metal material for constituting the pipe 2, it is preferred that the surface thereof be plated with nickel or gold so as to facilitate soldering.

In the case where the pipe 2 is a resin, for example, it is possible to employ a configuration in which gold or the like, for example, is deposited on the surface of the resin pipe 2, and the solder 34 is applied to the resulting deposited part, so as to cause a plurality of outer conductors 7 drawn out from within the pipe 2 to be joined to each other and secured to the pipe 2.

Also, it is possible to employ a configuration in which a plurality of outer conductors 7 drawn out from within the pipe 2 are secured to the pipe 2 with the adhesive 12, for example, as with the first embodiment.

Such a configuration can also yield effects similar to those of the first embodiment as a matter of course.

Additionally, the eighth embodiment is in such a state that, as shown in FIG. 16, the outer conductors 7 on the terminal side from the takeout portion 60 are removed so as to expose insulators 6, and these insulators 6 on the terminal side are removed so as to expose center conductors 5, thus making it easier to connect them to sensors, connectors, and the like as termination.

In place of the coaxial cable 4 stripped of the sheath 8 so as to expose the outer conductor 7, the coaxial cable 19 including the drain wire 23 of the first embodiment explained with reference to FIG. 7 can be stripped of the sheath 25 to expose the outer conductor (metal deposition film) 24 so as to be used as the cable shaped into a bent form in the takeout portion 60. Also, the configuration of the eighth embodiment can be combined with those of the second to seventh embodiments as a matter of course.

Figure 17:
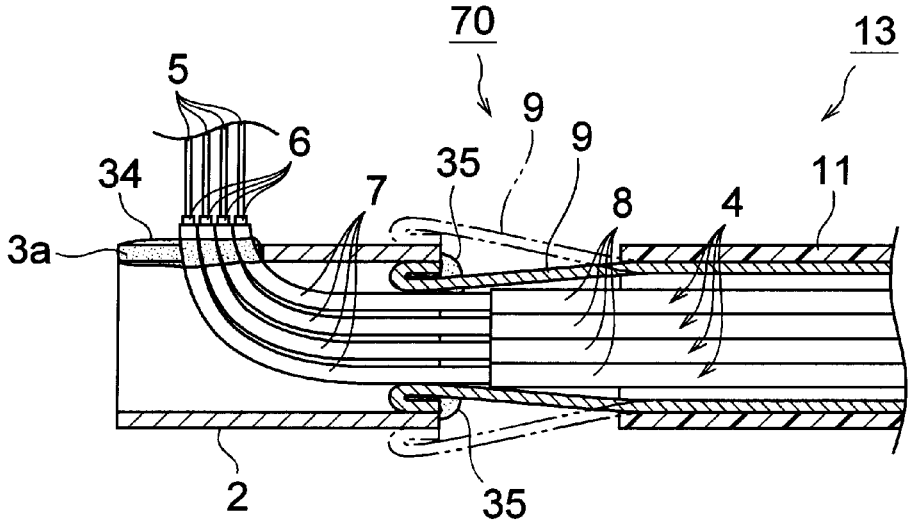

FIG. 17 is a vertical sectional view showing a ninth embodiment of the multiconductor cable in accordance with the present invention. While the takeout portion 70 of the ninth embodiment has a partly limited configuration of the takeout portion 60 of the eighth embodiment, a new configuration is added thereto, so as to yield an improved functionality.

Namely, the configuration of the takeout portion 60 of the eighth embodiment is partly limited in the takeout portion 70 of the ninth embodiment. Specifically, the pipe 2 is constituted by a solderable electrically conductive material such as a metal, for example, outer conductors 7 aligned by the slit 3*a* and drawn out from within the pipe 2 are joined to the pipe 2 by way of solder 34 so as to be conducted to each other via the pipe 2, and a plurality of coaxial cables 4 before reaching the pipe 2 are assembled in the form of a multiconductor cable 13 comprising a spirally wound conductor 9 as a grounding shield layer for containing these coaxial cables 4.

Also, in the takeout portion 70 of the ninth embodiment, a new configuration is added to the configuration of the takeout portion 60 in the eighth embodiment. Specifically, the spirally wound conductor 9 is drawn out of the outer sheath 11, so as to be joined to the pipe 2 by way of solder 35. Their joining position may be either on the inner periphery side or outer periphery side of the pipe as indicated by solid lines and phantom lines, respectively, in FIG. 17.

Such a configuration can also yield effects similar to those of the eighth embodiment as a matter of course. In addition, since the spirally wound conductor 9 containing the coaxial cables 4 is electrically connected to the pipe 2, a plurality of outer conductors 7 drawn out from within the pipe 2 by way of the slit 3*a* are conducted to the spirally wound conductor 9 via the pipe 2. As a consequence, even when the outer conductors 7 are not grounded in particular, they are grounded by way of the pipe 2 and the spirally wound conductor 9, whereby the cost of manufacture is cut down. Also, the spirally wound conductor 9 joined to the pipe 2 enhances the retention strength of the pipe 2, thus improving the reliability of the pipe 2 when external forces act thereon.

While the multiconductor cable 13 is employed as a mode of assembly before reaching the pipe 2 so as to draw out outer conductors 7 from inside the spirally wound conductor 9 of the multiconductor cable 13 containing them, arrange them in a row in the slit 3*a* of the pipe 2, and yield a bent form in FIG. 17, those not contained inside the spirally wound conductor 9 may also be arranged in a row in the slit 3*a* so as to yield the bent form. Namely, it will be sufficient if at least a part of those arranged in a row in the slit 3*a* so as to yield a bent form are contained inside the spirally wound conductor 9 before reaching the pipe 2 while the spirally wound conductor 9 containing at least a part thereof is electrically connected to the pipe 2.

In place of the coaxial cable 4 stripped of the casing 8 so as to expose the outer conductor 7, it is possible to use the coaxial cable 19 including the drain wire 23 stripped of the sheath 25 to expose the outer conductor 24 as a matter of course. Also, the configuration of the ninth embodiment can be combined with those of the second to seventh embodiments as a matter of course.

For simply enhancing the retention strength of the pipe 2, it may be a resin pipe. In this case, an adhesive, for example, may be used in place of the solder 34, 35.

The present invention is specifically explained with reference to its embodiments in the foregoing, but is not limited thereto. For example, though the pipe 2 is an annular pipe in the above-mentioned embodiments, it may be a square pipe. Also, the pipe 2 is not limited to the straight tube (linear pipe), but may be a tube partly or wholly curved according to the draw-out direction of the aligned cables.

While the takeout portions 1, 10, 20 to 60, 70 are applied to medical instruments such as an endoscope, electronic instruments such as a low-file notebook PC, and the like in the above-mentioned embodiments since their functions are fully exhibited therein, they are also applicable to others as a matter of course. In particular, they are effective when applied to the case where a plurality of cables are arranged in a narrow space.

Though the coaxial cable 4, the coated cable 5, the coaxial cable 4 stripped of the sheath 8 to expose the outer conductor 7, and the coaxial cable 19 including the drain wire 23 stripped of the sheath 25 to expose the outer conductor 24 are subjected to aligning and shaping into a bent form in the above-mentioned embodiments, without being restricted thereto, those having at least a conductor and an insulator covering the periphery of the conductor may be employed for this purpose.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A multiconductor cable in which a plurality of cables, each having at least a conductor and an insulator covering a periphery thereof, are aligned at a predetermined part thereof by an alignment member, wherein said alignment member includes a pipe in which said plurality of cables are inserted, with a slit extending in an axial direction thereof and having a width ranging from about 1 to 2 times the outside diameters of all of said cables, and a predetermined number of cables among said plurality of cables are drawn out from said pipe and secured while being aligned in said slit in the axial direction of said pipe.

2. A multiconductor cable according to claim 1, wherein each said cable is a coated cable in which said conductor is covered with said insulator.

3. A multiconductor cable according to claim 1, wherein each said cable is a coaxial cable comprising a center conductor, an insulator covering a periphery of said center conductor, and an outer conductor covering a periphery of said insulator.

4. A multiconductor cable according to claim 3, wherein each said coaxial cable further comprises a sheath covering a periphery of said outer conductor.

5. A multiconductor cable according to claim 3, wherein among said predetermined number of cables drawn out from said slit, said outer conductors thereof are joined to each other by way of an electrically conductive bonding layer and secured to said pipe.

6. A multiconductor cable according to claim 5, wherein said pipe is made of a solderable electrically conductive material, and wherein solder is used as said bonding layer.

7. A multiconductor cable according to claim 6, wherein at least a part of said plurality of cables is also contained in a grounded conductor tube, said conductor tube and said pipe being electrically connected to each other.

8. A multiconductor cable according to claim 1, wherein said slit extends from one end portion of said pipe to an intermediate portion of said pipe.

9. A multiconductor cable according to claim 8, wherein said pipe has another slit, at least one set of said slit, each set of said slit being constituted by said slits extending on a line from both ends of said pipe toward a center of said pipe, respectively.

10. A multiconductor cable according to claim 1, wherein said pipe has a plurality of said slits in a circumferential direction thereof.

11. A multiconductor cable according to claim 1, wherein the external surface of said pipe has a flat surface.

12. A multiconductor cable according to claim 1, wherein said pipe is disposed at an intermediate section of said plurality of cables.

13. A multiconductor cable according to claim 1, wherein said pipe is formed such that a periphery thereof is constituted by a combination of two or more constituent members at any position in the axial direction of said pipe.

14. A multiconductor cable according to claim 1, wherein said predetermined number of cables drawn out from said pipe are provided with a collective connector for securing and electrically connecting a terminal portion thereof.

15. An alignment member for aligning a plurality of cables, each having at least a conductor and an insulator covering a periphery thereof, at a predetermined part of said cables;

said alignment member having a pipe-like structure in which said plurality of cables are inserted, with a slit extending in an axial direction thereof and having a width ranging from about 1 to 2 times the outside diameters of all of said cables, said alignment member being capable of causing a predetermined number of cables among said plurality of cables to be drawn out from said pipe and secured while being aligned in said slit in the axial direction of said pipe.

16. A method of aligning a multiconductor cable in which a plurality of cables, each having at least a conductor and an insulator covering a periphery thereof, are aligned by a pipe-like alignment member at a predetermined part of said cables;

said method comprising the steps of:

inserting said plurality of cables into said pipe-like alignment member formed with a slit extending in an axial direction thereof and having a width ranging from about 1 to 2 times the outside diameters of all of said cables;

drawing out a predetermined number of cables among said plurality of cables from said alignment member;

aligning said drawn out cables in said slit in the axial direction of said alignment member; and securing said aligned cables.

* * * * *